US005566871A

United States Patent [19]

Weintraub

[11] Patent Number: 5,566,871

[45] Date of Patent: Oct. 22, 1996

[54] SHOULDER STRAP CUSHION

[76] Inventor: Marvin H. Weintraub, 5743 Kingsfield Dr., West Bloomfield, Mich. 48322

[21] Appl. No.: 335,466

[22] Filed: Nov. 7, 1994

Related U.S. Application Data

[63] Continuation-in-part of Ser. No. 112,674, Aug. 26, 1993, Pat. No. 5,361,957.

[51] Int. Cl.[6] ..... A45F 3/12

[52] U.S. Cl. ..... 224/264; 224/600; 224/901.2; 2/268; 297/482; 280/808

[58] Field of Search ..... 224/202, 264, 224/215, 907, 155; 2/2, 267, 268; 150/107, 110; 36/29; 280/733, 751, 808; 297/482, 488

[56] References Cited

U.S. PATENT DOCUMENTS

| | | | |
|---|---|---|---|
| 1,444,157 | 2/1923 | Lee | 224/264 |
| 3,185,362 | 5/1965 | Wakefield | 224/155 |
| 3,771,170 | 11/1973 | Leon | 2/2 |
| 3,883,053 | 5/1975 | Pritchard et al. | 224/264 |
| 3,914,881 | 10/1975 | Striegel | 36/29 |
| 4,183,156 | 1/1980 | Rudy | 36/29 |
| 4,384,602 | 5/1983 | Ores . | |
| 4,575,874 | 3/1986 | Johnson | 2/268 |
| 4,741,574 | 5/1988 | Weightman et al. | 297/482 |
| 4,837,859 | 6/1989 | Hamberg | 2/2 |
| 4,879,768 | 11/1989 | McClees et al. | 2/268 |
| 4,945,576 | 8/1990 | Melton | 2/268 |
| 5,189,738 | 3/1993 | Mitchell | 2/268 |
| 5,215,333 | 6/1993 | Knight | 297/482 |
| 5,274,846 | 1/1994 | Kolsky | 2/2 |

FOREIGN PATENT DOCUMENTS

| | | | |
|---|---|---|---|
| 2406402 | 6/1979 | France | 224/264 |
| 63244 | 2/1913 | Switzerland . | |
| 13758 | 9/1916 | United Kingdom . | |

*Primary Examiner*—Henry J. Recla
*Assistant Examiner*—Gregory M. Vidovich
*Attorney, Agent, or Firm*—Weintraub DuRoss & Brady

[57] ABSTRACT

A cushioning device for use with a shoulder strap or the like to distribute the load on the shoulder of the user comprises essentially a planar member having at least a central pocket formed therein in which is disposed a cushioning member and a fluid filled member. The fluid filled member, which is preferably an air filled bubble-type sheet acts as a load distribution device for distributing the load ordinarily placed upon the shoulder of the user. The device is formed from a soft, pliant material which can be folded back upon itself and which is locked together through a hook and loop fastener or similar locking device. The device hereof is particularly advantageous for use with shoulder straps associated with suitcases, briefcases, valises and similar totes.

8 Claims, 1 Drawing Sheet

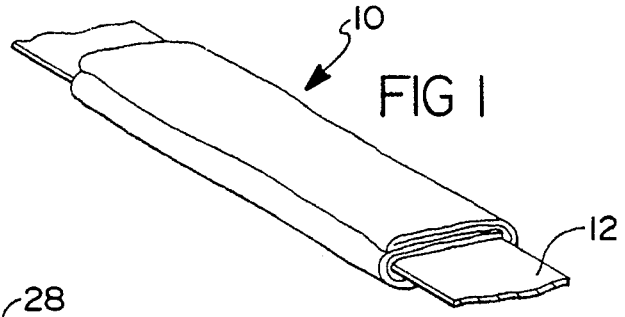
FIG 1
FIG 2
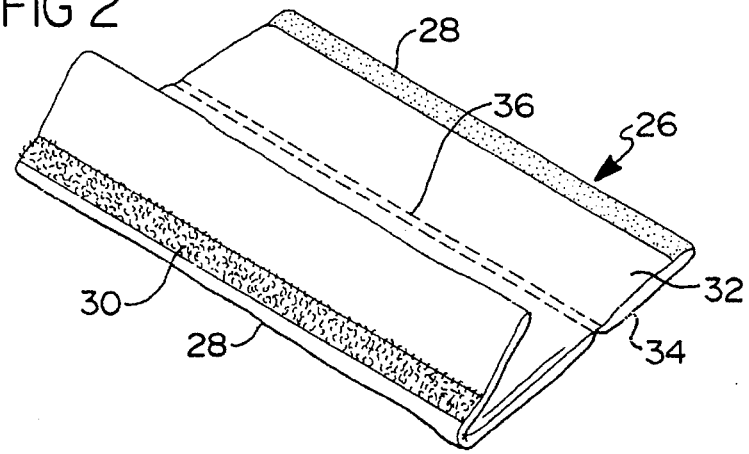
FIG 5
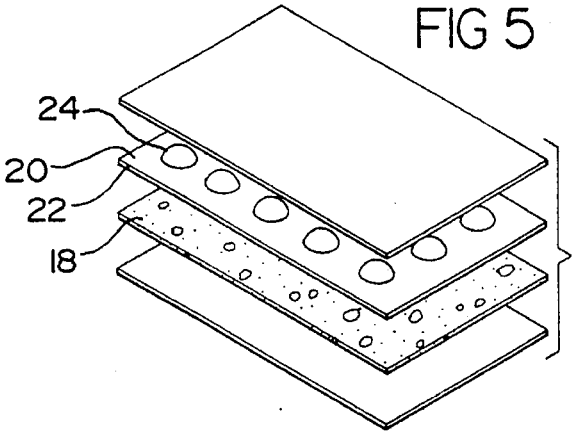
FIG 3
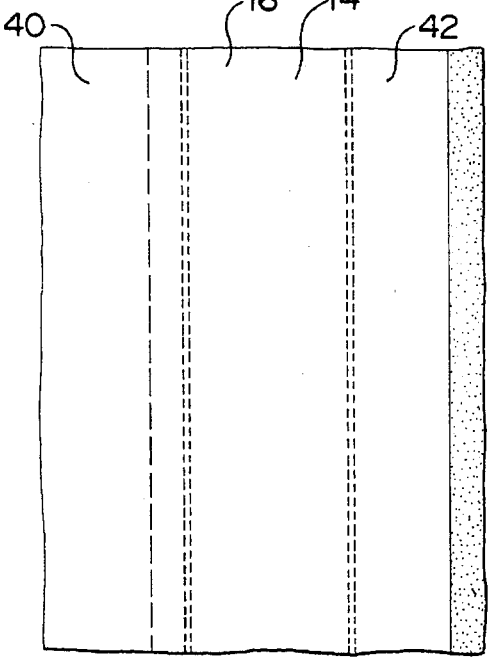
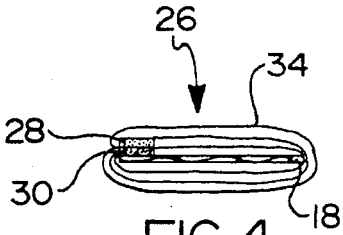
FIG 4

SHOULDER STRAP CUSHION

CROSS REFERENCE TO RELATED APPLICATION

This application is a continuation-in-part application of copending U.S. patent application Ser. No. 08/112,674, filed Aug. 26, 1993, now U.S. Pat. No. 5,361,957, for "Shoulder Strap Cushion", the disclosure of which is hereby incorporated by reference.

BACKGROUND OF THE INVENTION

1. Field of the Invention

The present invention relates to cushioning members. More particularly, the present invention relates to removably mountable cushioning members. Even more particularly, the present invention concerns cushioning members for shoulder straps and the like to facilitate the carrying of luggage and similar totes.

2. Prior Art

In the above referred to copending application there is disclosed a cushioning device to facilitate the carrying of luggage, etc. As disclosed in the copending application, the device thereof essentially comprises an envelope having cushioning members disposed therewithin. The cushioning device thereof can be directly integrated into the shoulder strap or may be removably mounted thereto.

Although the device of the copending application is efficacious for its intended purpose, it has been found that the device is at times difficult to position along the extent of the strap upon which it is mounted. Moreover, where the device is integrated into the strap itself, then its position is fixed.

Likewise, according to one embodiment of the device disclosed in the prior application it is necessary to inflate and deflate it, thereby detracting from the utility of the device.

The present invention, as will subsequently be detailed, overcomes some of the drawbacks encountered with the device disclosed in the copending application.

SUMMARY OF THE INVENTION

In accordance with the present invention there is provided a cushioning device or cushion particularly adapted for use with a shoulder strap, which generally comprises:

(a) a substantially planar member having an elongated pocket formed therein, (b) a cushioning member disposed within the pocket, (c) a fluid filled member adjacent to the cushioning member and disposed within the pocket, and (d) means for detachably lockably folding the member back upon itself.

By rendering the member foldable upon itself it is able to enshroud a strap, such as a shoulder strap or the like.

In accordance with the present invention, the planar member is formed from a soft material, such as felt or the like.

The cushioning member is preferably a cellular sponge-like material.

The fluid filled member generally comprises a sealed plastic material having a plurality of air or other fluid filled bubbles formed therewithin.

The combined effect of the cushioning member and the fluid filled member enhances the weight distribution or load bearing properties of the device.

For a more complete understanding of the present invention, reference is made to the following detailed description and accompany drawing.

In the drawing, like reference characters refer to like parts throughout the several views in which:

BRIEF DESCRIPTION OF THE DRAWING

FIG. 1 is a perspective view of the device hereof, in use;

FIG. 2 is a perspective view of the device hereof, in a partially folded condition;

FIG. 3 is a plan view of the device hereof;

FIG. 4 is a partial cross-sectional view of the device hereof; and

FIG. 5 is a partial, exploded view of the components of the pocket of the device hereof.

DESCRIPTION OF THE PREFERRED EMBODIMENT

With reference to the drawing, there is disclosed therein a cushioning device or shoulder strap cushion in accordance with the present invention and generally denoted at 10. The present invention is particularly adapted for use with a shoulder strap 12 or the like which is generally associated with a suitcase, valise, briefcase or similar tote. However, it is be understood that the present invention can be used wherever a cushioning device is desired to lessen the load emplaced upon the shoulder or other limb of the user.

Referring again to the drawing, the cushioning device 10 hereof generally comprises a substantially planar member 14 having an elongated pocket 16 formed therein. For ease of manufacture, it is preferred that the device 10 be a generally rectangular member having a major axis and minor axis with the pocket being disposed and formed along the major axis thereof to increase the load bearing area provided thereby. Preferably, the elongated pocket 16 is formed substantially centrally of the planar member.

Although not essential hereto, it is preferred that the planar member be formed from any suitable material which is soft, pliable and has a certain degree of stretchability to enable it to enshroud the strap 12 or similar member. Thus, synthetic materials such as polyester-type fabrics, felt, or the like may be used to form the planar member.

A cushioning member 18, comprising a cellulosic material such as a thin sponge-like material, is disposed within the pocket 16. The member 18 adds a cushioning effect to the device hereof. Also, the member 18 acts as a shield to protect a fluid-filled member likewise disposed within the pocket, as discussed herein below, from puncturing or the like.

The cellulosic material may be a polyurethane foam, natural sponge or the like.

The member 18 has a length and width substantially equal to that of the pocket and is disposed therewithin.

As noted hereinabove, a fluid filled member 20 is also disposed within the pocket 16 and overlies the member 18.

The fluid filled member 20 preferably comprises a thin plastic sheet 22 having a plurality of sealed bubbles 24 formed therein. The bubbles 24 are filled with a fluid, preferably air. The member 20 functions as a cushion as well as a load bearing member.

The plastic sheet 22 as well as the bubbles 24 are sealed to prevent the escape of fluid therefrom. In the event of rupture of any bubble, the fluid remains entrapped within the member 20.

The sheet 20 comprises a pair of spaced apart layers 21, 23 which are laminated together at the edges thereof to form the "bubbled" sheet or bubble pocket. Of course, the layers need not be laminated but can be heat sealed, sonically welded together or otherwise sealed to prevent the escape of fluid therefrom.

This type of "bubble pack" is well known and commercially available.

The fluid filled member has a length and width substantially equal to that of the pocket and is disposed therewithin adjacent to and in abutment with the cushioning member 18.

By virtue of the fluid contained within the member 20 the load placed upon the shoulder of a user when carrying a suitcase, etc. is distributed through this layer to ease pressure on the shoulder of the user.

As noted, the present device further comprises means generally denoted at 26 for detachably lockably mounting the device to the strap 12.

Preferably, the means 26 comprises a pair of spaced apart hook and loop fasteners 28, 30 respectively. Hook and loop fasteners are well known and commercially available, such as that sold under the trademark "VELCRO". Of course, other means such as snaps, pins, or the like can be used to render the device detachably mountable to the strap 12.

As particularly shown in FIG. 2, the device 10 hereof generally has a first strip 28 disposed along an outer edge thereof on a first side thereof. The second strip 30 is disposed interiorly of the member 14 adjacent one edge of the pocket 16, as shown.

Preferably, in the manufacture of the device hereof the planar member comprises first and second sheets 32 and 34 which are then secured together such as by sewing, bonding, or the like. Substantially centrally disposed elongated seams 36, 38 respectively, are provided to divide the member 14 into segments. The pocket 16 is the substantially central segment. Thus, the first strip 28 is disposed substantially at the outer edge of the first side 32 and the second strip 30 is disposed adjacent the seam on the second side 34, such that when the device is folded the hook and loop fasteners oppose each other.

Further, by dividing the member 14 into segments additional pockets 40, 42 respectively are also provided which may have a cushioning material, such as the cushioning material 18, or a fluid filled member, such as fluid filled member 20, or a combination thereof, likewise disposed within the adjacent pockets. This will be contingent upon the bulk and degree of cushioning desired. However, at least the central pocket has both a cushioning member and a fluid filled member disposed therewithin. Preferably, a cushioning member or layer is disposed in the lateral pockets.

In use, the device 10 hereof is positioned on the strap 12 at the desired location. It is then folded back upon itself to enshroud the desired portion of the strap, and it is then detachably locked together via the locking means 26. The device 10 is then placed on the shoulder to cushion the load imparted thereto.

Also, in placing the cushioning member and/or the fluid filled member within its associated pocket, it may be fixed in position therewith by sewing or the like. This precludes any shifting of these members which could lessen its cushioning effect.

It is to be appreciated from the preceding that there has been described herein a cushioning device which enables easy positioning and which provides enhanced cushioning to the shoulder of a user.

Having thus described the invention, what is claimed is:

1. A cushioning device for encircling a portion of a strap, comprising:

(a) a substantially planar member comprising first and second spaced apart layers and having a pocket formed between the layers, the planar member having a length and width and being segmented into a central pocket segment and a lateral segment on each side of the central pocket segment, the layers being formed from a pliant material, the lateral segments being foldable into an overlying relationship over the central pocket segment to thereby encircle a strap portion disposed therebetween, (b) a cushioning member disposed in at least the central pocket segment, (c) a fluid filled member insertingly disposed in at least the central pocket segment in abutment with the cushioning member, and (d) means for releasably holding the lateral segments in the overlying relationship, the means being disposed on the lateral segments and in cooperable relationship when folded over the central pocket segment.

2. The device of claim 1 wherein each lateral segment has a pocket formed therein.

3. The device of claim 1 wherein:

the fluid filled member is an air-filled member.

4. The device of claim 3 wherein: the fluid filled member comprises a pair of sealed sheets, each sheet having a plurality of bubbles formed therein, the bubbles having the fluid disposed therein.

5. A cushioning device, comprising:

(a) a substantially planar member being foldable upon itself to encircle a portion of a strap and comprising first and second spaced apart layers, the member being segmented and comprising a first lateral pocket, a central pocket and a second lateral pocket, the lateral pockets being on opposite sides of the central pocket, (b) a cushioning member disposed in the central pockets, (c) a fluid filled member insertingly disposed in the central pocket in abutment with the cushioning member, and (d) means for releasably holding the planar member to itself when being folded upon itself to encircle the portion of the strap disposed between segments.

6. The device of claim 5 which further comprises:

a cushioning member disposed in at least one of the lateral pockets.

7. The device of claim 6 which further comprises:

a fluid filled member insertingly disposed in at least one lateral pocket.

8. The device of claim 5 which further comprises:

(a) a cushioning member insertingly disposed in each lateral pocket, and (b) a fluid filled member disposed in each lateral pocket.

* * * * *